US005374778A

United States Patent [19]

Hashimoto et al.

[11] Patent Number: 5,374,778

[45] Date of Patent: Dec. 20, 1994

[54] WIRE HARNESS

[75] Inventors: Masayoshi Hashimoto; Yoshiaki Yamano; Kenji Mizutani, all of Yokkaichi, Japan

[73] Assignee: Sumitomo Wiring Systems, Ltd., Japan

[21] Appl. No.: 139,280

[22] Filed: Oct. 19, 1993

[30] Foreign Application Priority Data

Nov. 2, 1992 [JP] Japan ..... 4-317831

[51] Int. Cl.[5] ..... H01B 7/34

[52] U.S. Cl. ..... 174/36; 174/72 A; 174/102 R; 174/105 R; 174/106 R

[58] Field of Search ..... 174/36, 102 R, 106 R, 174/72 A, 72 R, 105 R

[56] References Cited

U.S. PATENT DOCUMENTS

| | | | |
|---|---|---|---|
| 2,576,163 | 11/1951 | Weston et al. | 174/28 |
| 3,555,169 | 1/1971 | Miller | 174/36 |
| 4,340,771 | 7/1982 | Watts | 174/36 |
| 4,816,614 | 3/1989 | Baigrie et al. | 174/36 |
| 4,822,956 | 4/1989 | Sepe | 174/36 |
| 4,835,394 | 5/1989 | Steele | 250/385.1 |
| 4,920,235 | 4/1990 | Yamaguchi | 174/36 |
| 5,091,604 | 2/1992 | Kirma | 174/72 A |
| 5,132,490 | 7/1992 | Aldissi | 174/36 |
| 5,171,937 | 12/1992 | Aldissi | 174/36 |
| 5,191,173 | 3/1993 | Sizer et al. | 174/105 |
| 5,216,202 | 6/1993 | Yoshida et al. | 174/36 |

FOREIGN PATENT DOCUMENTS

| | | | |
|---|---|---|---|
| 209826 | 1/1987 | European Pat. Off. . | |
| 236096 | 9/1987 | European Pat. Off. . | |
| 2053424 | 5/1972 | Germany | 174/36 |
| 2654880 | 6/1978 | Germany . | |
| 30042 | 10/1982 | Germany . | |
| 120624 | 12/1991 | Japan . | |
| 2213309 | 8/1989 | United Kingdom . | |

*Primary Examiner*—Morris H. Nimmo
*Attorney, Agent, or Firm*—Jordan B. Bierman

[57] ABSTRACT

Insulatedly coated wires (10) each coated with a metal foil of good electric conductivity and a metal foil of high magnetic permeability to form an electrostatic shielding layer (20) and a magnetic shielding layer (30), are bundled and are connected at their opposite ends to connectors. Each wire is adapted to be shielded with the metal foils in place of the conventional braided tube, thereby providing an easy-to-manufacture wire harness having good shielding effects adjacent the connectors.

12 Claims, 3 Drawing Sheets

WIRE HARNESS

BACKGROUND OF THE INVENTION

1. Field of the Invention

The present invention relates to a wire harness for use in electronic equipments, copying machines, facsimiles, automotive vehicles, and the like and, more particularly, to a wire harness which is easily manufactured and is excellent in shielding properties.

2. Description of the Background Art

In the past, the wire bundle portion of a wire harness has been coated with a braided tube formed of a conductive material to eliminate the influences of noises generated within an automotive vehicle or the like.

To manufacture such a wire harness with a shield, it is necessary to insert the wire harness into the braided tube of predetermined length corresponding to the wire harness after the production of the wire harness, resulting in more working operations of necessity.

For a wire harness having one end connected to a master connector and the other end connected to a plurality of secondary connectors, a need exists to insert each bundle of wires connected to a secondary connector into the braided tube, resulting in much more working operations.

Further, the braided tube must be spaced apart from a terminal of the connector in order to insulate the braided tube and the terminal from each other. It is, however, difficult to correctly position the braided tube relative to the terminal in the foregoing manufacturing method. For this reason, the braided tube is spaced relatively greatly away from the terminal of the connector in consideration for the degree of freedom of manufacturing. This might result in insufficient shielding effect of the braided tube adjacent the terminal.

SUMMARY OF THE INVENTION

According to the present invention, a wire harness comprises: a plurality of shielded wires formed into a bundle, and connectors connected respectively to opposite ends of the shielded wires, each of the shielded wires including an insulatedly coated wire, an electrostatic shielding layer, and a magnetic shielding layer, the electrostatic shielding layer and the magnetic shielding layer covering the insulatedly coated wire throughout its length, the electrostatic shielding layer being formed of a first metal foil of good electric conductivity, the magnetic shielding layer being formed of a second metal foil of high magnetic permeability.

According to another aspect of the present invention, a wire harness comprises: a plurality of shielded wires formed into a bundle, and connectors connected respectively to opposite ends of the shielded wires, each of the shielded wires including an insulatedly coated wire, an electrostatic shielding layer, and a magnetic shielding layer, the electrostatic shielding layer and the magnetic shielding layer covering the insulatedly coated wire throughout its length, the electrostatic shielding layer being formed of a metal foil of good electric conductivity, the magnetic shielding layer being formed of a first metal layer of high magnetic permeability plated or deposited on the metal foil of good electric conductivity.

The wire harness is manufactured in normal process steps by using the insulatedly coated wires each coated with the metal foil of good electric conductivity and the metal foil of high magnetic permeability.

Since each of the insulatedly coated wires is shielded as long as its ends, the shielding effects from electric and magnetic fields are not lowered adjacent the connectors.

According to still another aspect of the present invention, a wire harness comprises: a plurality of shielded wires formed into a bundle, a first shielding layer for covering the bundle, and connectors connected respectively to opposite ends of the shielded wires, each of the shielded wires including an insulatedly coated wire and a second shielding layer for covering the insulatedly coated wire throughout its length, one of the first and second shielding layers being formed of a first metal foil of good electric conductivity, the other shielding layer being formed of a second metal foil of high magnetic permeability.

The wire harness is manufactured in normal process steps by using the insulatedly coated wires each coated with the metal foil of good electric conductivity. The wire bundle portion of the wire harness is coated with the metal foil of high magnetic permeability coiled therearound.

As above described, the wire harness of the present invention in which each of the insulatedly coated wires is shielded with the metal foil in place of the conventional braided tube, is easily manufactured and provides good shielding effects adjacent the connectors.

Further, each of the insulatedly coated wires or the bundle thereof is coated with the metal foil of high magnetic permeability. This also provides magnetic shielding effects.

It is therefore an object of the present invention to provide various types of wire harnesses which are manufactured in fewer working operations and which provide good shielding effects adjacent connectors.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
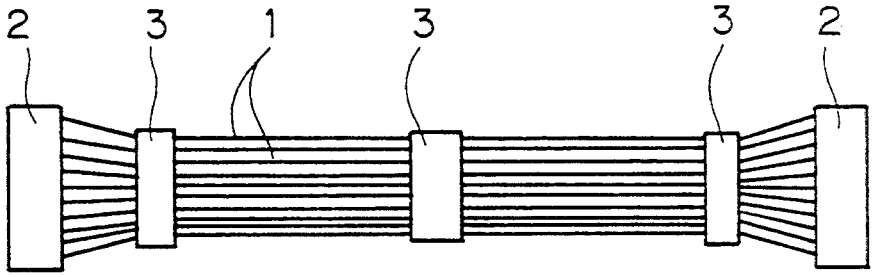
FIG. 1 is a plan view of a wire harness according to a first preferred embodiment of the present invention.

Referring to the drawings, preferred embodiments will be described hereinafter according to the present invention.

Referring to FIG. 1, a wire harness according to a first preferred embodiment of the present invention comprises a plurality of shielded wires 1 having opposite ends connected to connectors 2 and bundled with adhesive tapes 3.

Figure 2:
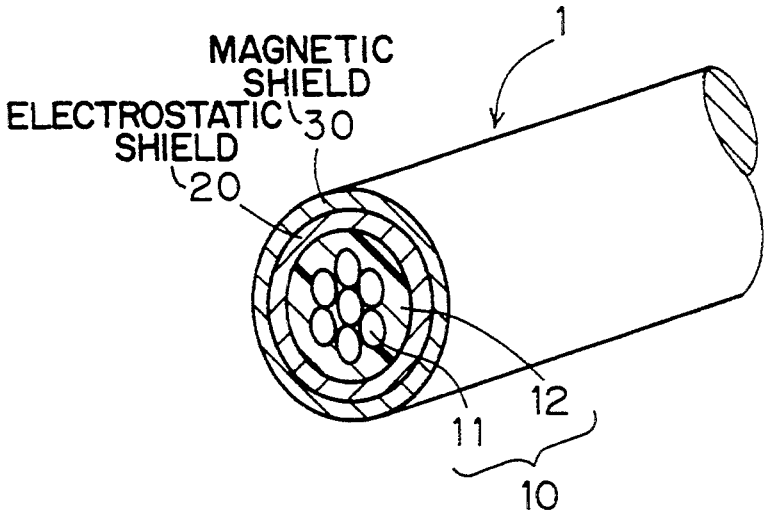
FIG. 2 is a perspective view of a wire for use in the first preferred embodiment.

Each of the shielded wires 1 is formed with an insulatedly coated wire 10 including several core wires (copper wires) 11 and an insulative resin 12 covering the core wires 11, an electrostatic shielding layer 20, and a magnetic shielding layer 30. The electrostatic shielding layer 20 and the magnetic shielding layer 30 are formed of a metal foil of good electric conductivity and a metal foil of high magnetic permeability, respectively, which cover the insulatedly coated wire 10 throughout its length, as shown in FIG. 2. The electrostatic shielding layer 20 is bonded to the insulatedly coated wire 10 with an adhesive (not shown) and the magnetic shielding layer 30 is bonded to the electrostatic shielding layer 20 with an adhesive (not shown).

Figure 3:
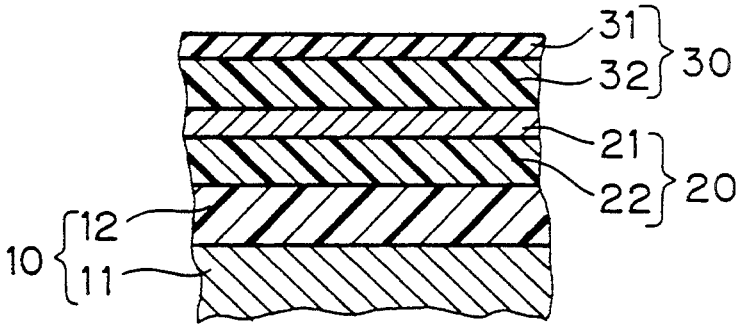
FIG. 3 is a sectional view of FIG. 2.

The electrostatic shielding layer 20 and the magnetic shielding layer 30 are of double layer construction consisting of metal layers 21, 31 and polyester layers 22, 32, respectively, as shown in FIG. 3. The double layer construction is adopted for the purpose of reinforcing the metal layers with the polyester layers for enhancement of workability because a single metal layer, if provided, is very disadvantageous in strength.

The metal layer 21 is typically made of a rectal of good electric conductivity such as copper and aluminum. The metal layer 31 is typically made of a metal of high magnetic permeability such as iron and nickel. Preferably, the respective metal layers 21 and 31 are 20 μm or less in thickness. The thicker the metal layers 21 and 31 are, the greater the shielding effects thereof are. However, too great thickness of the metal layers 21 and 31 impairs the flexibility of the wire harness.

Polyimide layers or polyvinyl chloride layers may be substituted for the polyester layers 22 and 32. Polyester layers are, however, more advantageous in consideration for costs and strength.

Figure 4:
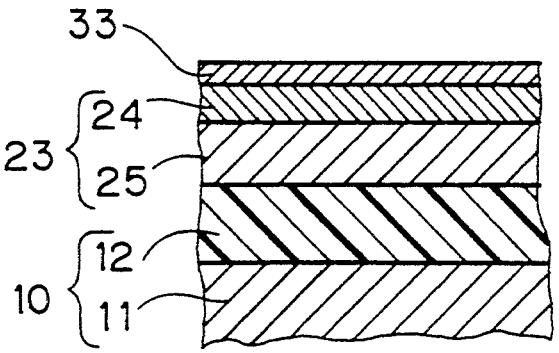
FIG. 4 is a sectional view showing a second preferred embodiment.

The electrostatic shielding layer 20 having the metal foil of good electric conductivity and the magnetic shielding layer 30 having the metal foil of high magnetic permeability coat the wire 10 independently in the first preferred embodiment, which requires two working steps. In a second preferred embodiment according to the present invention, the metal foils may be formed integrally to reduce the working steps. Specifically, metal of high magnetic permeability should be plated or deposited on an electrostatic shielding layer 23 of good electric conductivity consisting of a metal layer 24 and a polyester layer 25 to form a magnetic shielding layer 33, as shown in FIG. 4. The metal layer 24 is made of copper or aluminum and the magnetic shielding layer 33 is made of nickel or iron.

A third preferred embodiment according to the present invention will be discussed hereinafter.

Figure 5:
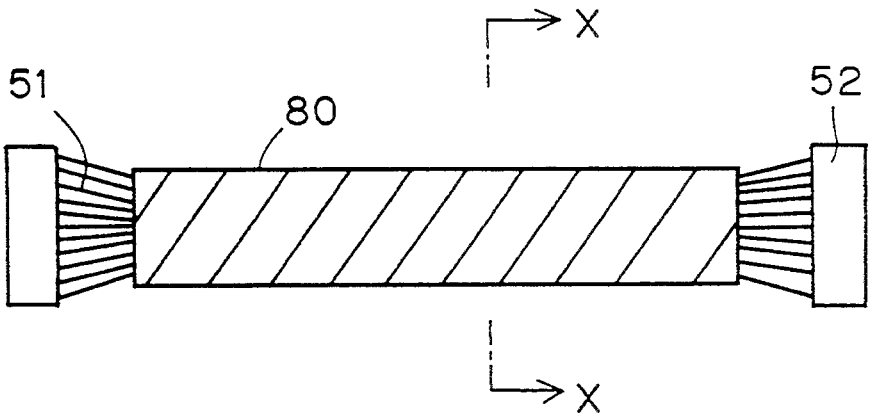
FIG. 5 is a plan view showing a third preferred embodiment.

Referring to FIG. 5, the wire harness of the third preferred embodiment comprises a plurality of shielded wires 51 having opposite ends connected to connectors 52, and a magnetic shielding layer 80 formed by coiling a metal foil tape of high magnetic permeability around the bundled shielded wires 51.

Figure 6:
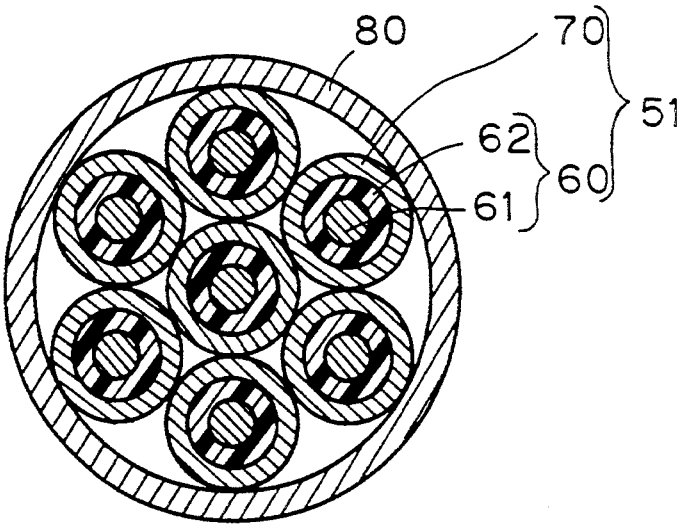
FIG. 6 is a sectional view taken along the line X—X of FIG. 5.

Each of the shielded wires 51 is formed with an insulatedly coated wire 60 similar to that of the first preferred embodiment which includes a core wire 61 and an insulative resin 62 covering the core wire 61, and an electrostatic shielding layer 70 formed by coating the insulatedly coated wire 60 with a metal foil of good electric conductivity throughout its length, as shown in FIG. 6.

The metal foil of the electrostatic shielding layer 70 and the metal foil tape of the magnetic shielding layer 80 are of double layer construction, like the metal foil of the first preferred embodiment. That is, the electrostatic shielding layer 70 consists of a metal layer of good electric conductivity such as copper and aluminum and a polyester layer, and the magnetic shielding layer 80 consists of a metal layer of high magnetic permeability such as iron and nickel and a polyester layer. The electrostatic shielding layer 70 is bonded to the insulatedly coated wire 60 with an adhesive (not shown) and the magnetic shielding layer 80 is bonded to the electrostatic shielding layers 70 with an adhesive (not shown).

As above described, each of the insulated coated wires 60 is coated with the electrostatic shielding layer 70, and the metal foil tape of high magnetic permeability is coiled around the whole wire bundle of the shielded wires 51 to form the magnetic shielding layer 80. Conversely, each of the insulated coated wires 60 may be coated with the metal foil of high magnetic permeability to form the magnetic shielding layer while the metal foil tape of good electric conductivity is coiled around the whole wire bundle to form the electrostatic shielding layer.

While the invention has been shown and described in detail, the foregoing description is in all aspects illustrative and not restrictive. It is therefore understood that numerous modifications and variations can be devised without departing from the scope of the invention.

What is claimed is:

1. A wire harness comprising:

a plurality of shielded wires formed into a bundle, and connectors connected respectively to opposite ends of said shielded wires, each of said shielded wires including an insulatedly coated wire, an electrostatic shielding layer, and a magnetic shielding layer, said electrostatic shielding layer and said magnetic shielding layer covering said insulatedly coated wire throughout its length, said electrostatic shielding layer being formed of a first metal foil of good electric conductivity, said magnetic shielding layer being formed of a second metal foil of high magnetic permeability.

2. The wire harness of claim 1, wherein said first metal foil is of double layer construction consisting of a first metal layer and a first polyester layer, and said second metal foil is of double layer construction consisting of a second metal layer and a second polyester layer.

3. The wire harness of claim 2, wherein said first metal layer is made of copper or aluminum, and said second metal layer is made of iron or nickel.

4. The wire harness of claim 2, wherein each of said first and second metal layers is not more than 20 μm in thickness.

5. A wire harness comprising:

a plurality of shielded wires formed into a bundle, and connectors connected respectively to opposite ends of said shielded wires, each of said shielded wires including an insulatedly coated wire, an electrostatic shielding layer, and a magnetic shielding layer, said electrostatic shielding layer and said magnetic shielding layer covering said insulatedly coated wire throughout its length, said electrostatic shielding layer being formed of a metal foil of good electric conductivity, said magnetic shielding layer being formed of a first metal layer of high magnetic permeability plated or deposited on said metal foil of good electric conductivity.

6. The wire harness of claim 5, wherein said metal foil is of double layer construction consisting of a second metal layer and a polyester layer.

7. The wire harness of claim 6, wherein said first metal layer is made of iron or nickel, and said second metal layer is made of copper or aluminum.

8. The wire harness of claim 6, wherein each of said first and second metal layers is not more than 20 μm in thickness.

9. A wire harness comprising:

a plurality of shielded wires formed into a bundle, a first shielding layer for covering said bundle, and connectors connected respectively to opposite ends of said shielded wires, each of said shielded wires including an insulatedly coated wire and a second shielding layer for covering said insulatedly coated wire throughout its length, one of said first and second shielding layers being formed of a first metal foil of good electric conductivity, the other shielding layer being formed of a second metal foil of high magnetic permeability.

10. The wire harness of claim 9, wherein said first metal foil is of double layer construction consisting of a first metal layer and a first polyester layer, and said second metal foil is of double layer construction consisting of a second metal layer and a second polyester layer.

11. The wire harness of claim 10, wherein said first metal layer is made of copper or aluminum, and said second metal layer is made of iron or nickel.

12. The wire harness of claim 10, wherein each of said first and second metal layers is not more than 20 μm in thickness.

* * * * *